US012005283B2

(12) United States Patent
Geissler et al.

(10) Patent No.: US 12,005,283 B2
(45) Date of Patent: Jun. 11, 2024

(54) CROSSBAR ASSEMBLY FOR AN EXERCISE LADDER AND AN EXERCISE LADDER ARRANGEMENT INCORPORATING SAME

(71) Applicant: Ingenious Moves LLC, Denver, CO (US)

(72) Inventors: Thomas W. Geissler, Denver, CO (US); Lindsey D. Hanahan, Denver, CO (US)

(73) Assignee: Ingenious Moves LLC, Denver, CO (US)

( * ) Notice: Subject to any disclaimer, the term of this patent is extended or adjusted under 35 U.S.C. 154(b) by 185 days.

(21) Appl. No.: 17/636,346

(22) PCT Filed: Aug. 19, 2020

(86) PCT No.: PCT/US2020/047037
§ 371 (c)(1),
(2) Date: Feb. 17, 2022

(87) PCT Pub. No.: WO2021/034954
PCT Pub. Date: Feb. 25, 2021

(65) Prior Publication Data

US 2022/0288437 A1 Sep. 15, 2022

Related U.S. Application Data

(60) Provisional application No. 62/889,213, filed on Aug. 20, 2019.

(51) Int. Cl.
*A63B 1/00* (2006.01)
*A63B 21/16* (2006.01)

(52) U.S. Cl.
CPC ..... *A63B 1/00* (2013.01); *A63B 21/16* (2013.01); *A63B 2209/10* (2013.01); *A63B 2225/093* (2013.01)

(58) Field of Classification Search
CPC ..... A63B 1/00; A63B 21/16; A63B 2209/10; A63B 2225/093; A63B 1/005;
(Continued)

(56) References Cited

U.S. PATENT DOCUMENTS 4,440,263 A 4/1984 Smith
D622,787 S 8/2010 Masterson et al.
(Continued)

FOREIGN PATENT DOCUMENTS

CN 106139512 A 11/2016
CN 108452509 A 8/2018
(Continued)

OTHER PUBLICATIONS

International Search Report and the Written Opinion of the International Searching Authority dated Dec. 8, 2020 for PCT International Application No. PCT/US2020/047037.
(Continued)

*Primary Examiner* — Sundhara M Ganesan
*Assistant Examiner* — Jacqueline N L Loberiza
(74) *Attorney, Agent, or Firm* — David F. Dockery; The Navitas Intellectual Property Group LLC

(57) ABSTRACT

A removable crossbar assembly and an exercise ladder arrangement including the removable crossbar assembly. The crossbar assembly is configured to be secured to an exercise ladder to provide an exercise crossbar disposed between two fixed exercise crossbars on the exercise ladder. The crossbar assembly may also include a brace for securing an independent exercise device to the crossbar assembly. The crossbar assembly advantageously provides the placement of a crossbar for exercising closer to the desired height of a participant, e.g., closer to the should height of a participant, to increase the efficacy of the exercise.

24 Claims, 11 Drawing Sheets

(58) Field of Classification Search
CPC ..... A63B 17/04; A63B 17/00; E06C 1/36; E06C 1/12; E06C 7/48; A47F 10/00
See application file for complete search history.

(56) References Cited

U.S. PATENT DOCUMENTS

| | | | | |
|---|---|---|---|---|
| 7,931,570 | B2 | 4/2011 | Hoffman | |
| 8,029,425 | B2 | 10/2011 | Bronston et al. | |
| D667,899 | S | 9/2012 | Bronston et al. | |
| 8,500,611 | B2 | 8/2013 | Hoffman | |
| 2009/0072111 | A1* | 3/2009 | Piane, Jr. ..... | A63B 69/222<br>248/309.1 |
| 2019/0175976 | A1 | 6/2019 | Breland et al. | |

FOREIGN PATENT DOCUMENTS

| | | | |
|---|---|---|---|
| CN | 207886593 | U | 9/2018 |
| CN | 106968590 | B | 3/2019 |
| EP | 3459602 | A1 | 3/2019 |
| KR | 200399266 | Y1 | 10/2005 |
| KR | 20180002204 | U | 7/2018 |
| WO | 2009067157 | A1 | 5/2009 |

OTHER PUBLICATIONS

Extended European Search Report dated Aug. 31, 2023 for European Patent Application No. 20854310.8.
Office Action dated Mar. 22, 2023 for Canadian Patent Application No. 3, 148,557.

* cited by examiner

CROSSBAR ASSEMBLY FOR AN EXERCISE LADDER AND AN EXERCISE LADDER ARRANGEMENT INCORPORATING SAME

CROSS-REFERENCE TO RELATED APPLICATIONS

This application claims the priority benefit of U.S. Provisional Patent Application No. 62/889,213 by Geissler et al. and filed on Aug. 20, 2019, which is incorporated herein by reference in its entirety.

FIELD

This disclosure relates to the field of exercise devices, particularly to ladder-type exercise devices and their accessories.

BACKGROUND

A variety of exercise devices are used to strengthen the body and/or to improve balance, etc. Some exercise devices include an exercise ladder having spaced-apart vertical supports and a plurality of horizontal exercise crossbars (e.g., rungs) between the supports that are vertically spaced-apart. See, for example, U.S. Pat. No. 7,931,570 by Hoffman, which is incorporated herein by reference in its entirety and attached hereto.

One problem associated with such devices is that many exercises require the participant to hold onto or otherwise utilize a crossbar on the ladder that is very closely matched to a point on a participant's body, e.g., a crossbar that is about the same height as the participant's shoulders. However, such exercise ladders typically utilize permanently mounted crossbars that are spaced apart at a regular distance, such as about 8 inches apart. Thus, while a particular crossbar may be properly positioned for a participant having a shoulder height closely matching the height of a crossbar, many participants will be forced to use a crossbar that is not closely aligned with their shoulder height, thereby diminishing the efficacy of the exercise.

SUMMARY

It is an objective of the present disclosure to provide a removable crossbar assembly for use with an exercise ladder. The removable crossbar assembly advantageously enables a participant to perform an exercise using the crossbar assembly in a position (e.g., at a height) that would not otherwise be obtainable using the permanent (e.g., fixed) rungs on the exercise ladder.

In one embodiment, a removable crossbar assembly is provided. The crossbar assembly includes first and second horizontally spaced-apart brackets that are configured to be attached to an exercise ladder. The first and second brackets each comprise a planar body having an inner surface and an outer surface, each surface bounded by a top edge, a bottom edge, a front edge and a back edge. A lower vertical support notch is formed in each planar body and is configured to operatively receive a first exercise ladder crossbar therein. An upper vertical support notch is formed in each planar body, above and substantially vertically colinear with the lower vertical support notch and is configured to receive a second exercise ladder crossbar therein. An exercise assembly crossbar extends from the first bracket to the second bracket. The exercise assembly crossbar is affixed to each of the first and second brackets between the lower vertical support notch and the upper vertical support notch.

The foregoing crossbar assembly is subject to a number of characterizations and refinements that may be implemented individually or in any combination. In one characterization, the lower vertical support notches are formed in the bottom edge of the planar bodies. In another characterization, the upper vertical support notch is accessed through a gap formed in a back edge of the planar bodies to enable the second exercise ladder crossbar to be placed through the gap and into the upper vertical support notch. In another characterization, the exercise assembly crossbar is affixed to the brackets at a point approximately on-half the distance between the upper vertical support notches and the lower vertical support notches. In another characterization, the crossbar assembly further comprises a horizontal plank extending from the first bracket to the second bracket, where the horizontal plank is affixed to each of the first and second brackets near the top edge and the back edge of the first and second brackets.

In another characterization, each of the first and second brackets further comprises a brace extending outwardly from the front edge of the planar body, the brace comprising an exercise equipment receiving notch configures for receiving and securing an additional piece of exercise equipment to the assembly. In one refinement, the exercise equipment receiving notch is disposed in a top edge of the brace. In another refinement, the exercise equipment receiving notch is spaced away from the front edge of the first and second brackets. In another refinement, the equipment receiving notch is substantially vertically coplanar with the exercise assembly crossbar.

In another embodiment, an exercise ladder arrangement is provided. The exercise ladder arrangement comprises an exercise ladder having first and second spaced-apart vertical supports and a plurality of exercise ladder crossbars affixed to the first and second vertical support and extending therebetween. A crossbar assembly is removably secured to the exercise ladder. The crossbar assembly comprises first and second horizontally spaced-apart brackets. The brackets each comprise a planar body having an inner surface and an outer surface, each surface bounded by a top edge, a bottom edge, a front edge and a back edge. The brackets each comprise a lower vertical support notch operatively securing a first exercise ladder crossbar therein, and an upper vertical support notch formed in the planar body, above and substantially vertically colinear with the lower vertical support notch, and securing a second exercise ladder crossbar therein. An exercise assembly crossbar extends from the first bracket to the second bracket, where the exercise assembly crossbar is affixed to each of the first and second brackets.

The foregoing exercise ladder arrangement is subject to a number of characterizations and refinements that may be implemented individually or in any combination. In one characterization, the exercise assembly crossbar is affixed to each of the first and second brackets at a point approximately one-half the distance between the lower vertical support notch and the upper vertical support notch. In another characterization, the exercise ladder arrangement further comprises a horizontal plank extending from the first bracket to the second bracket, where the horizontal plank is affixed to each of the first and second brackets near the top edge and the back edge of the first and second brackets. In another characterization, the exercise ladder arrangement further comprises at least first and second securement straps securing the attachment exercise crossbar to the first exercise ladder crossbar to deter vertical movement of the removable attachment. In one refinement, the securement straps comprise a hook and loop fastener.

In another characterization, each of the first and second brackets further comprises a brace extending from the front edge of the planar body, the brace comprising an exercise equipment receiving notch disposed therein. In one refinement, the exercise equipment receiving notch is disposed in a top edge of the brace. In another refinement, the exercise equipment receiving notch is spaced away from the front edge of the first and second brackets. In another refinement, the exercise equipment receiving notch is substantially vertically coplanar with the attachment exercise crossbar. In another characterization, the exercise ladder arrangement includes at least a first spacer element disposed on at least one of the first and second exercise ladder crossbars between the vertical ladder support and the removable exercise assembly.

DESCRIPTION OF THE EMBODIMENTS

Figure 1:
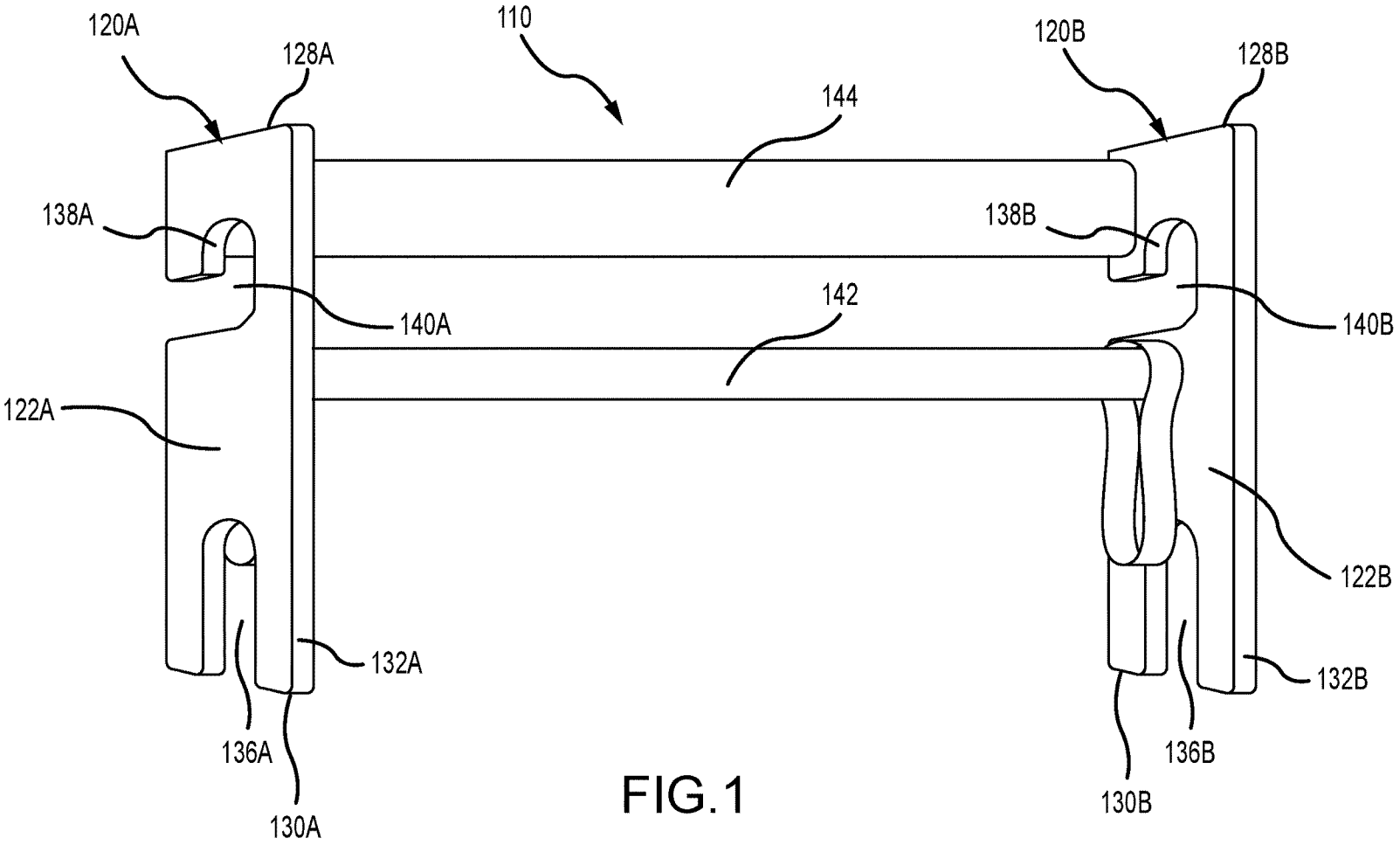
FIG. 1 illustrates a perspective view of a removable crossbar assembly for an exercise ladder according to an embodiment of the present disclosure.
Figure 2A:
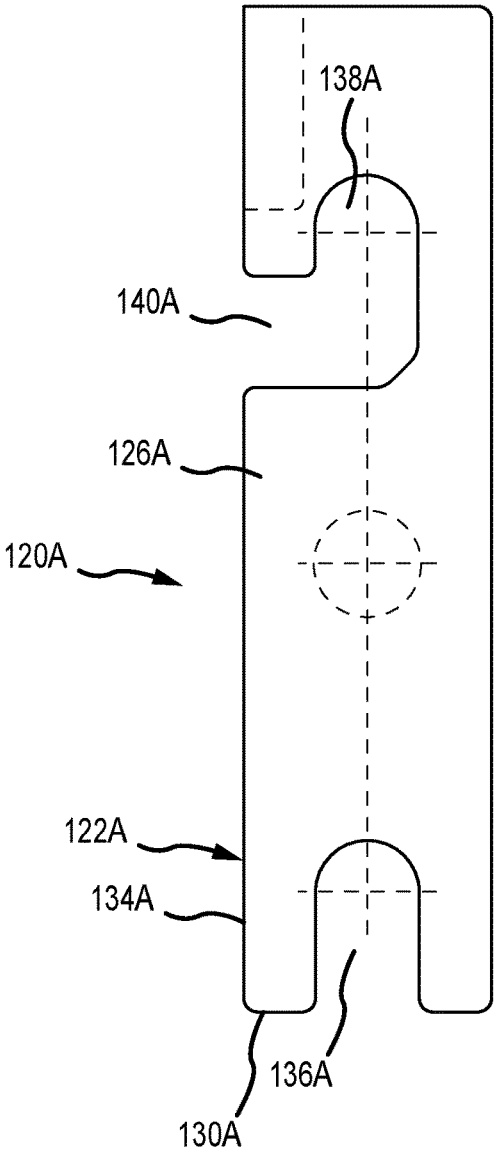
FIGS. 2A and 2B illustrate end views of a removable crossbar assembly for an exercise ladder according to an embodiment of the present disclosure.
Figure 2B:
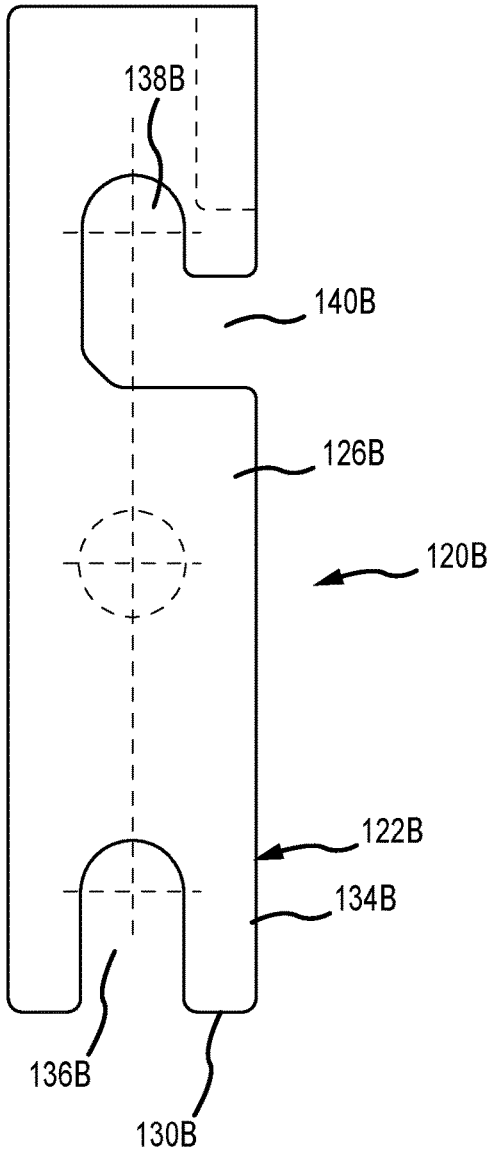
Figure 3A:
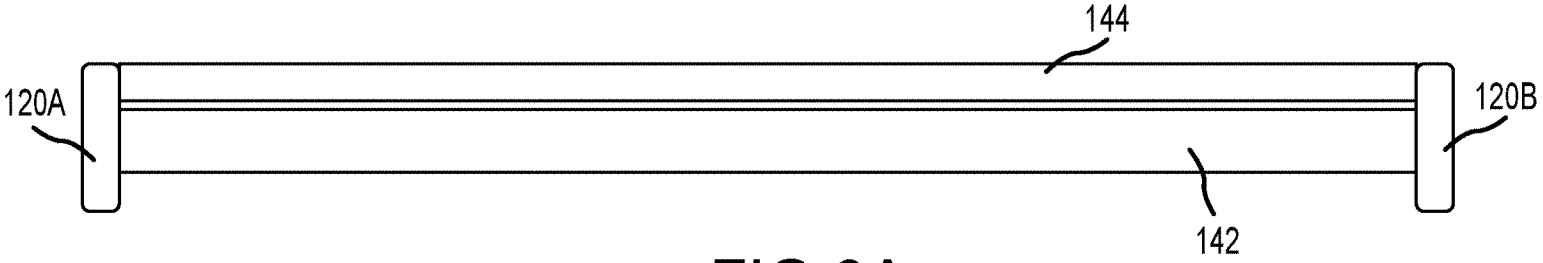
FIGS. 3A and 3B illustrate top and front views of a removable crossbar assembly for an exercise ladder according to an embodiment of the present disclosure.
Figure 3B:
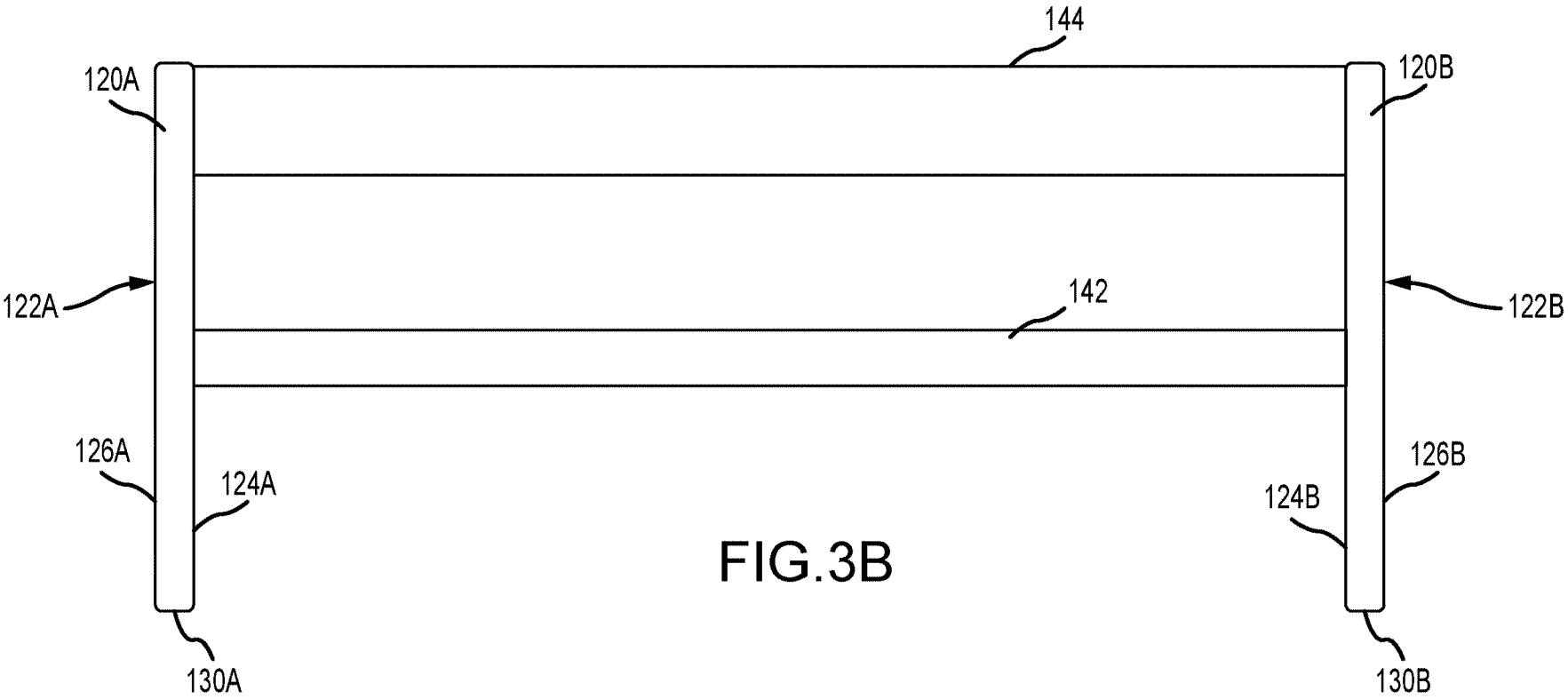

FIGS. 1 to 3 illustrate several views of a removable crossbar assembly for an exercise ladder according to an embodiment of the present disclosure. FIG. 1 is a perspective view of a removable crossbar assembly, FIGS. 2A and 2B illustrate two side (e.g., end) views of a removable crossbar assembly, and FIGS. 3A and 3B illustrate a top view and a front view of a removable crossbar assembly.

Referring to FIGS. 1 to 3, the removable crossbar assembly 110 includes a first bracket 120A and a second bracket 120B that is spaced away from (e.g., horizontally spaced-away from) the first bracket 120A. The brackets 120A/120B are configured to be operatively secured to an exercise ladder (e.g., as in FIGS. 4 to 6). Specifically, as illustrated in FIGS. 1 to 3, the brackets 120A/120B each include a planar body 122A/122B having notches or a similar feature to facilitate the secure attachment of the assembly 110 to an exercise ladder. Each of the planar bodies 122A/122B includes an inner surface 124A/124B and an outer surface 126A/126B bounded by a top edge 128A/128B, a bottom edge 130A/130B, a front edge 132A/132B and a back edge 134A/134B. A lower vertical support notch 136A/136B is formed, e.g., in each of the bottom edges and each notch is configured (e.g. sized and shaped) to receive a first (lower) exercise ladder crossbar within the lower notch 136A/136B. An upper vertical support notch 138A/138B is formed in each planar body, above and substantially vertically colinear with the lower vertical support notch 136A/136B, as shown in FIGS. 2A and 2B. The upper vertical support notches 138A/138B are configured (e.g., sized and shaped) to receive a second exercise ladder crossbar therein, e.g., a second exercise crossbar that is adjacent to and spaced apart from (e.g. vertically spaced above) the first exercise ladder crossbar. A gap 140A/140B is formed in the back edge 134A/134B of the planar body and provides access to the upper vertical support notch 138A/138B to enable the second exercise ladder crossbar to be placed through the gap 140A/140B and into the upper vertical support notch 138A/138B, e.g., without necessitating removal of a crossbar from the exercise ladder.

An exercise assembly crossbar 142 extends across the assembly, e.g., extends from the inner surface 124A of the first bracket 120A to the inner surface 124B of the second bracket 120B. As illustrated in FIG. 3A (top view) and FIG. 3B (front view), the exercise assembly crossbar 142 is affixed to the first and second brackets 120A/120B, e.g. to the inner surface 124A/124B of each of the first and second brackets. As used herein, the term "affixed" is to be broadly construed, and includes being attached using a fastener (e.g., a nail and/or screw), being affixed using an adhesive, and/or being inserted partially or completely through the planar bodies 122A and 122B. The assembly crossbar 142 illustrated in FIGS. 2A and 2B and in FIGS. 3A and 3B is affixed at a point approximately one-half way (e.g., one-half the distance) between the lower vertical support notch 136A/136B and the upper vertical support notch 138A/138B, e.g. at a midpoint. However, the exercise assembly crossbar 142 may be offset from the midpoint between the notches, e.g., as is illustrated in FIG. 1 where the assembly crossbar 142 is placed nearer the upper notches 140A/140B. To facilitate use during exercise, the exercise assembly crossbar 142 may have a substantially circular cross-section, e.g., in the form of a cylindrical dowel or rod, although other cross-sections such as a polygonal (e.g., rectangular) may also be utilized.

In the embodiment illustrated in FIGS. 1 to 3, the crossbar assembly 110 also includes a horizontal plank 144 extending along the back side of the assembly, e.g., extending from the first bracket 120A to the second bracket 120B. The horizontal plank 144 is affixed to each of the first and second brackets 120A/120B at or near the top edge 128A/128B and at or near the back edge 134A/134B of the first and second brackets. As is described below, the plank 144 may advantageously provide a planar surface against which a participant can push (e.g., for a resistance-based exercise), as opposed to pushing against a round crossbar.

The crossbar assembly 110 (e.g., the brackets, the crossbar, and the plank) may be fabricated from a variety of materials such as plastics, composite materials, etc., and in one embodiment is fabricated from wood. Further, different components may be fabricated from different materials if desired.

Figure 4:
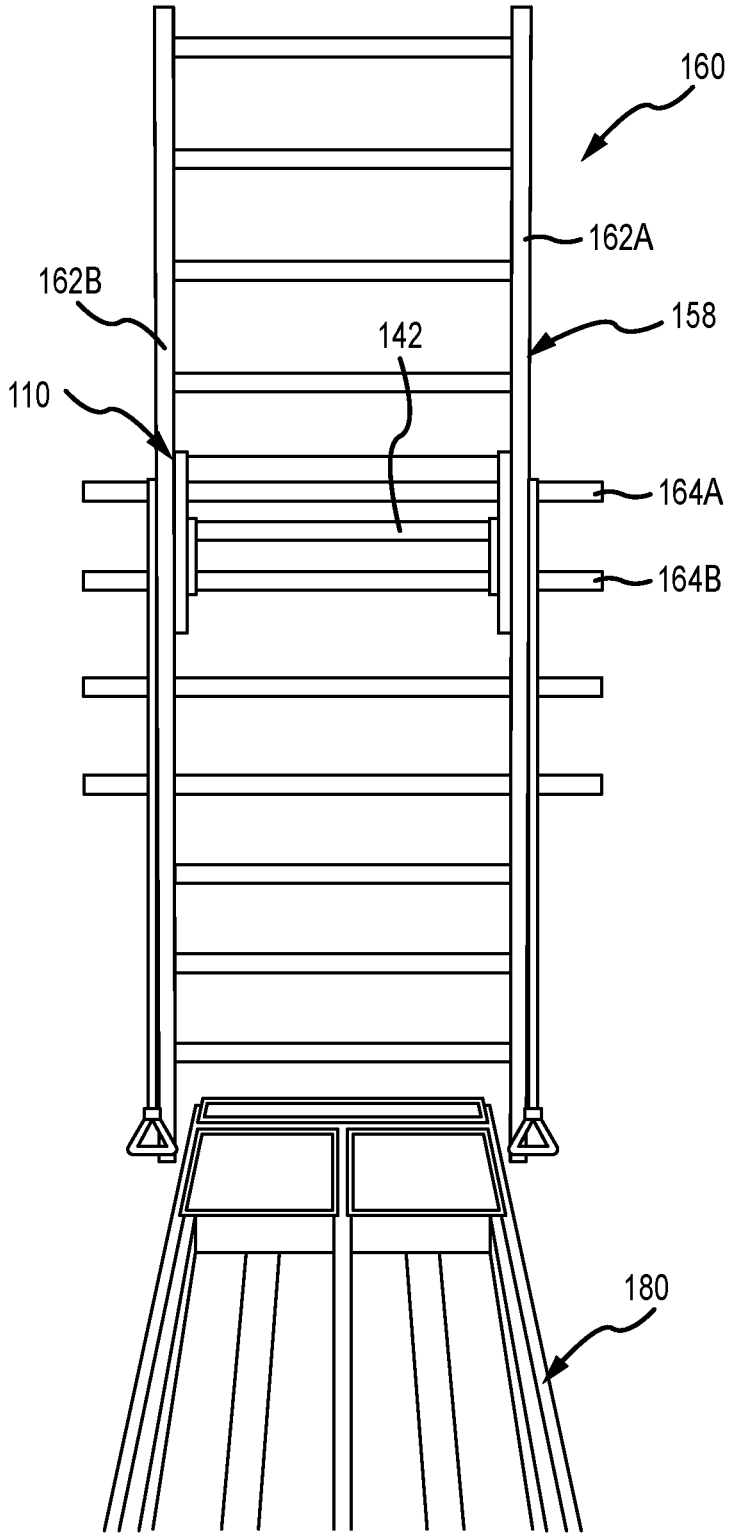
FIG. 4 illustrates a removable crossbar assembly that is secured to an exercise ladder according to an embodiment of the present disclosure.
Figure 5:
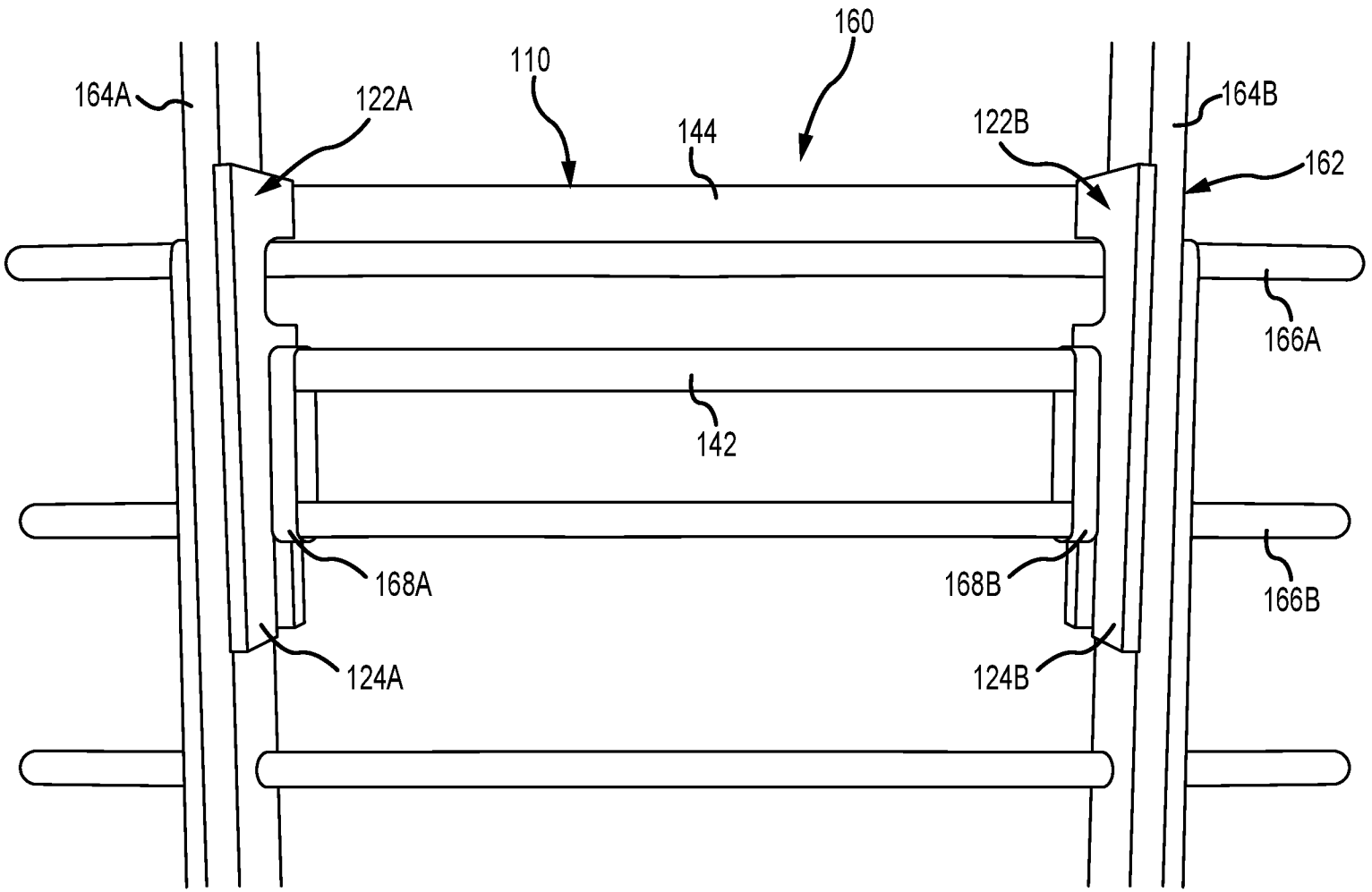
FIG. 5 illustrates a removable crossbar assembly that is secured to an exercise ladder according to an embodiment of the present disclosure.
Figure 6:
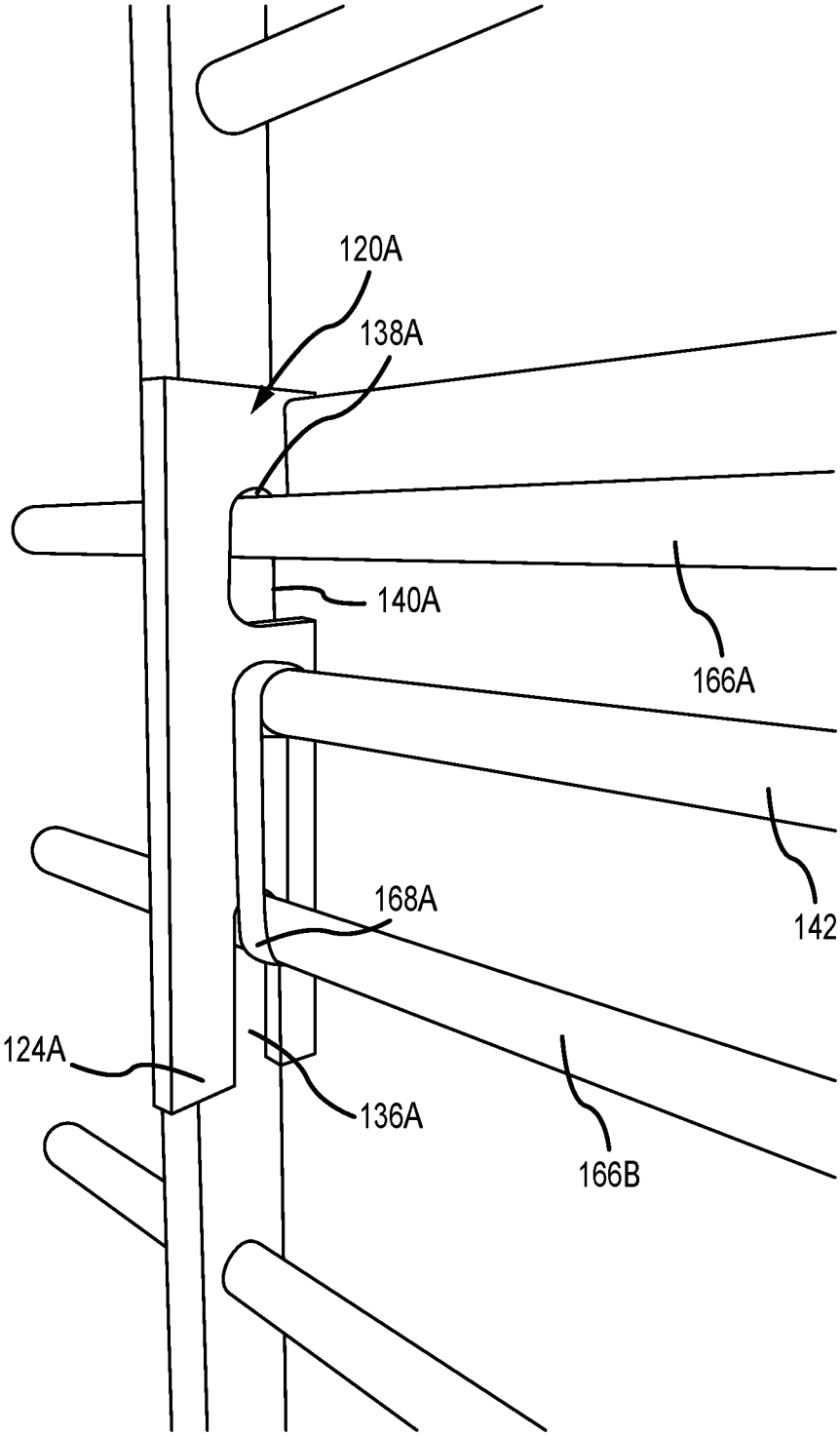
FIG. 6 illustrates a partial view of a removable crossbar assembly that is secured to an exercise ladder according to an embodiment of the present disclosure.

FIGS. 4 to 6 illustrate an exercise ladder arrangement 160 incorporating a removable crossbar assembly 110 to facilitate use of the exercise ladder 162, e.g., to provide an intermediate crossbar height between two fixed crossbars on the exercise ladder 162. As illustrated in FIGS. 4 to 6, the exercise ladder 162 includes first and second spaced-apart vertical supports 164A/164B and a plurality of fixed exercise crossbars (e.g., adjacent crossbars 166A and 166B) extending between and affixed to the first and second vertical supports 164A/164B. The exercise crossbars 166A/166B have a substantially circular cross-section, e.g., to provide a comfortable gripping surface for an exercise participant. A removable crossbar assembly 110 is secured to the exercise ladder 162, i.e., is secured to crossbars 166A/166B by placing the lower attachment notches onto the lower crossbar 166B and the upper attachment notches onto the upper crossbar 164A, e.g., by passing the crossbar 166A through the gaps 140A/140B to engage the notches 138A/138B. The removable assembly is configured substantially as illustrated in FIGS. 1 to 3 and includes first and second horizontally spaced-apart brackets 120A/120B as described above for securing the assembly 110 to the ladder 162. As illustrated in FIGS. 1 to 3, the notches 136A/136B and 138A/138B include curved inner surfaces for receiving the circular (e.g., cylindrical) exercise crossbars therein. Securement straps 168A/168B, e.g., double-sided hook and loop (e.g., VELCRO®) straps, may be wrapped around the attachment crossbar 142 and the lower fixed crossbar 166B, for example, to further secure the assembly 110 to the ladder 162, e.g., to deter upward movement of the assembly with respect to the exercise ladder during use.

As illustrated in FIG. 4, the exercise ladder 162 may be associated with other devices such as the exercise device 180, which includes two platforms that are movable along parallel tracks. Such a device is illustrated in U.S. Pat. No. 7,931,570 by Hoffman and U.S. Design Pat. No. D622,787 by Masterson et al., each of which is incorporated herein by reference in its entirety. As can be seen in FIG. 4, the removable crossbar assembly 110 enables the assembly crossbar 142 to be located at positions (e.g., heights) that are not obtainable with the fixed crossbars on the exercise ladder 162. By way of example, the fixed crossbars may be spaced at intervals of about 8 inches. The removable crossbar assembly 110 therefore enables the participant to select a height at 4-inch intervals rather than 8-inch intervals, and more closely align with the exercise participant's shoulder height, for example.

As best illustrated in FIG. 5, the assembly 110 has a width, e.g., the distance between the outer surfaces of the brackets 122A/122B, that is substantially the same as the interior width of the exercise ladder 162, e.g., the distance between inner surfaces of the vertical supports 164A/164B. For example, the width of the crossbar assembly 110 may be such that the outer surfaces of the brackets 124A/124B are in contact with the inner surfaces of the vertical supports 164A/164B. In this manner, the crossbar assembly 110 is restricted from horizontal movement during use. Alternatively, and as illustrated below, the crossbar assembly 110 may have a smaller width and one or more spacer elements may be placed on a fixed crossbar to restrict horizontal movement of the crossbar assembly 110, as is described below.

Figure 7:
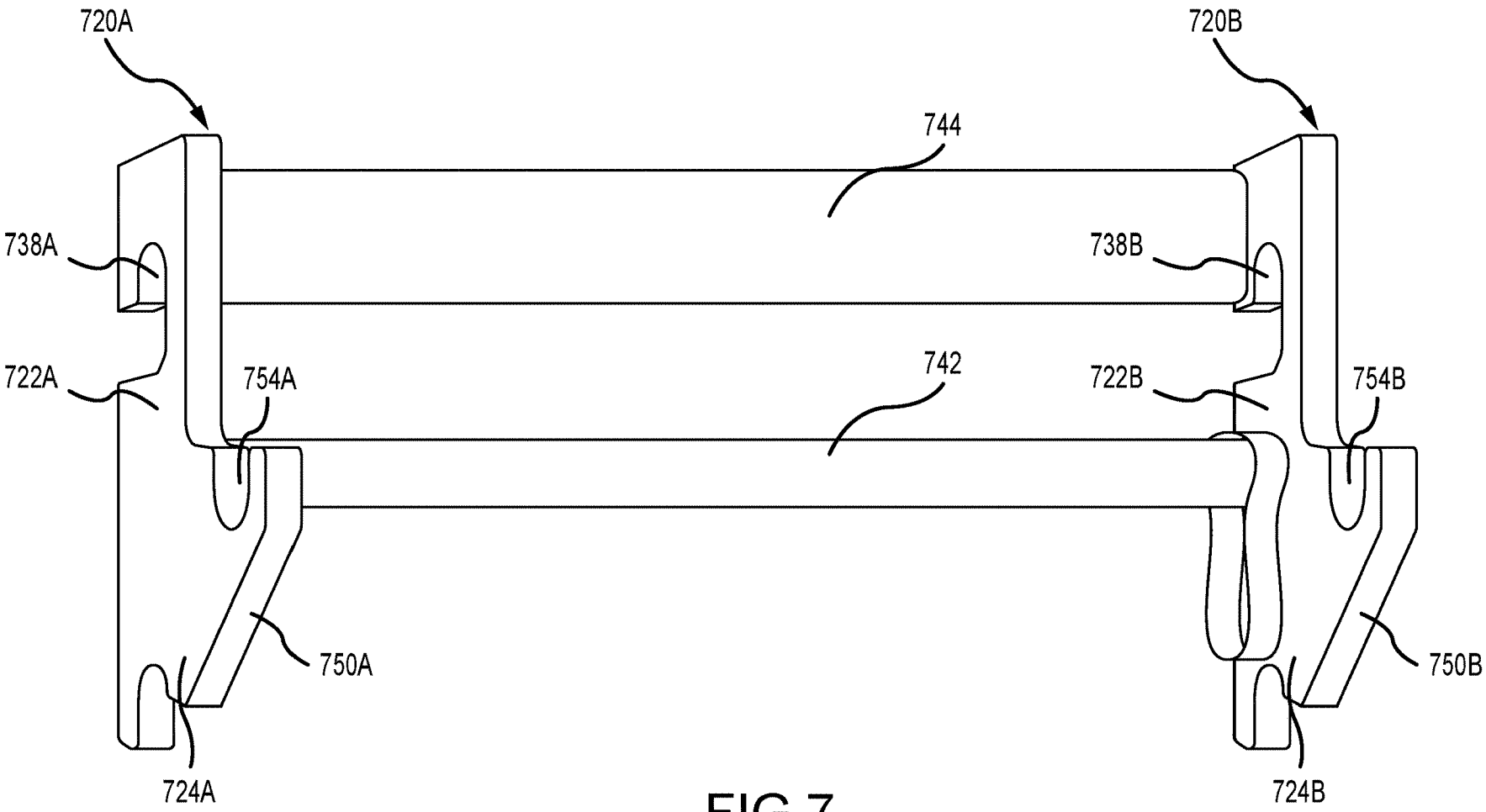
FIG. 7 illustrates a removable crossbar assembly for an exercise ladder according to an embodiment of the present disclosure.
Figure 8B:
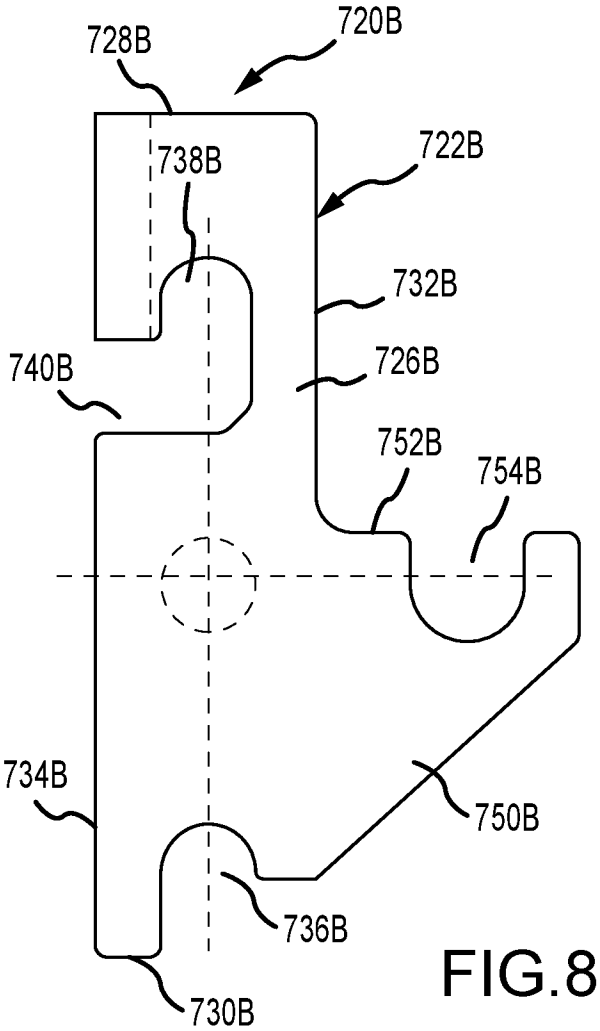
FIGS. 8A and 8B illustrate side views of a removable crossbar assembly for an exercise ladder according to an embodiment of the present disclosure.
Figure 8A:
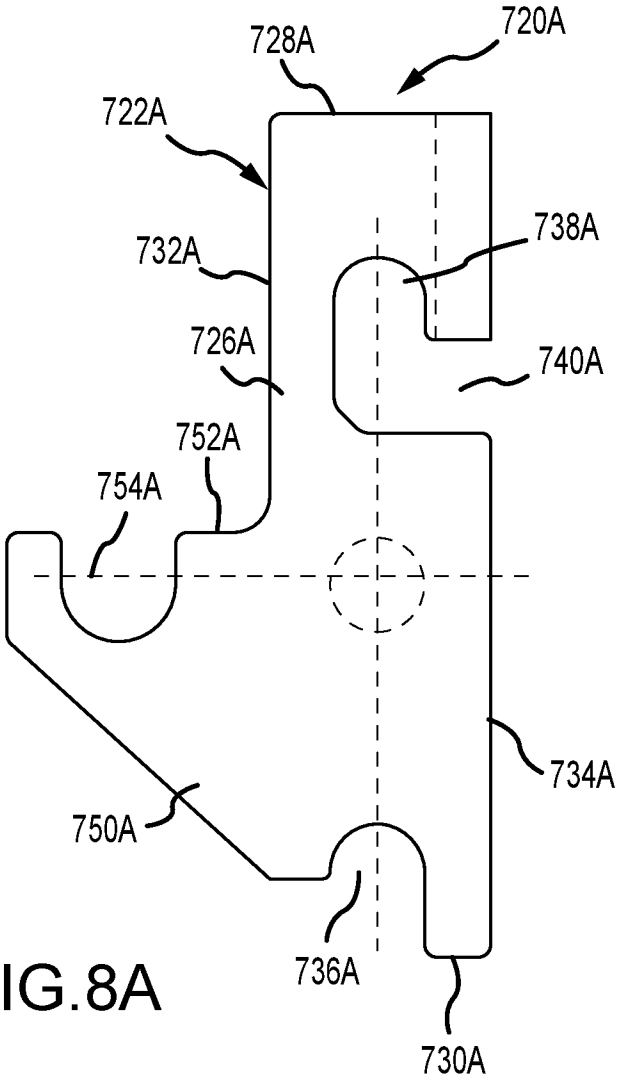
Figure 9:
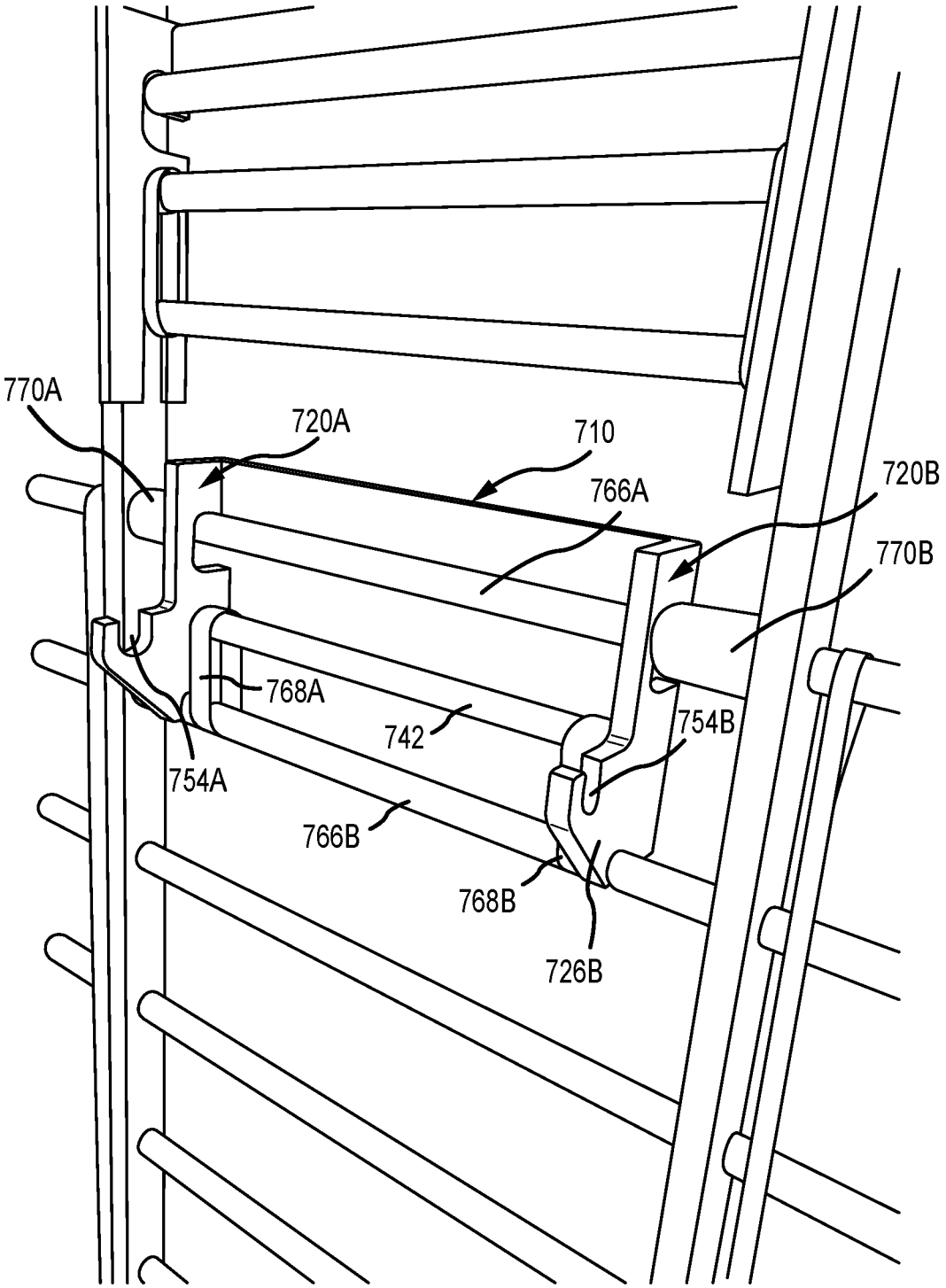
FIG. 9 illustrates a removable crossbar assembly for an exercise ladder according to an embodiment of the present disclosure.
Figure 10:
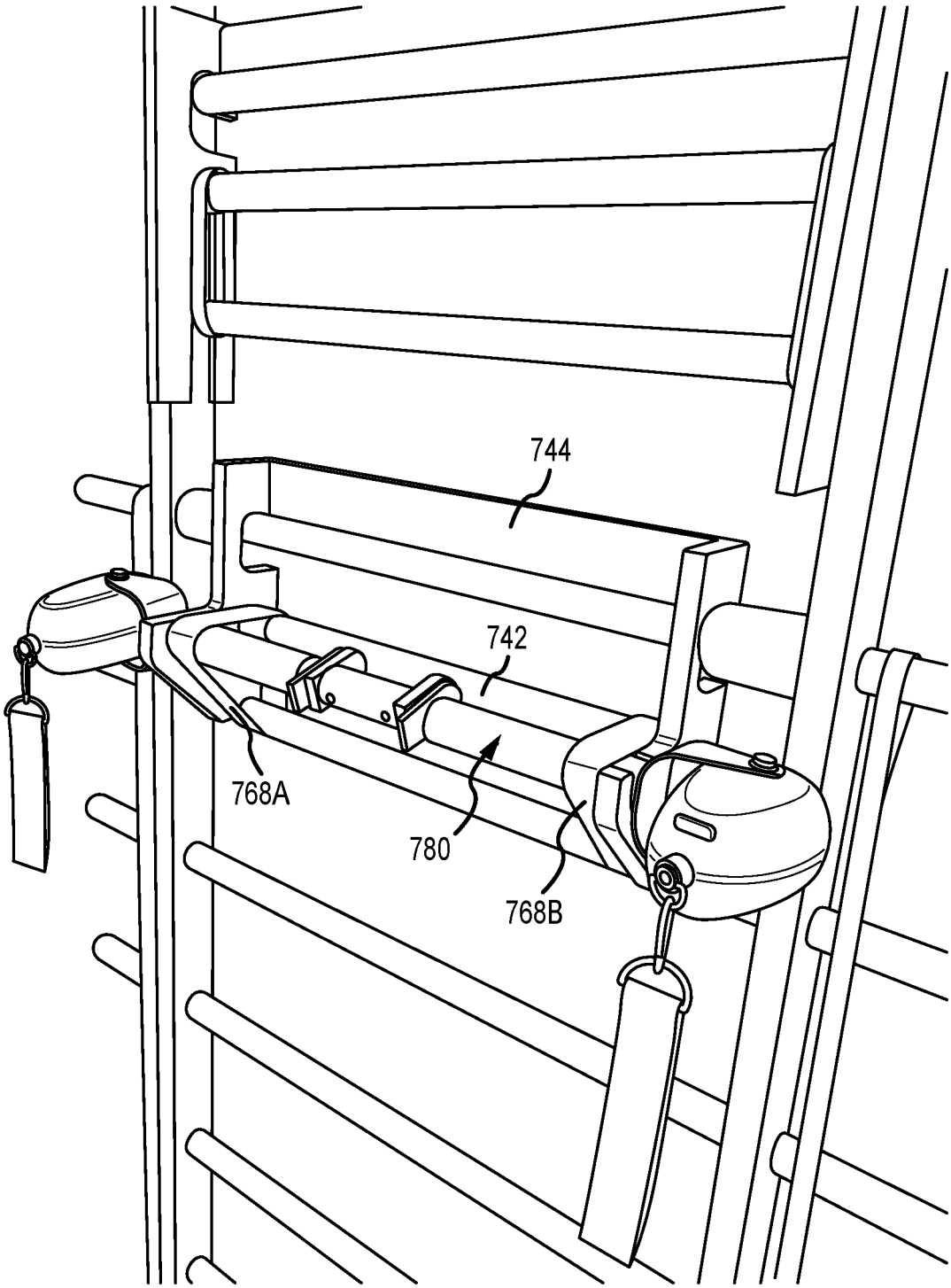
FIG. 10 illustrates a removable crossbar assembly that is secured to an exercise ladder and supporting an exercise device according to an embodiment of the present disclosure.
Figure 11:
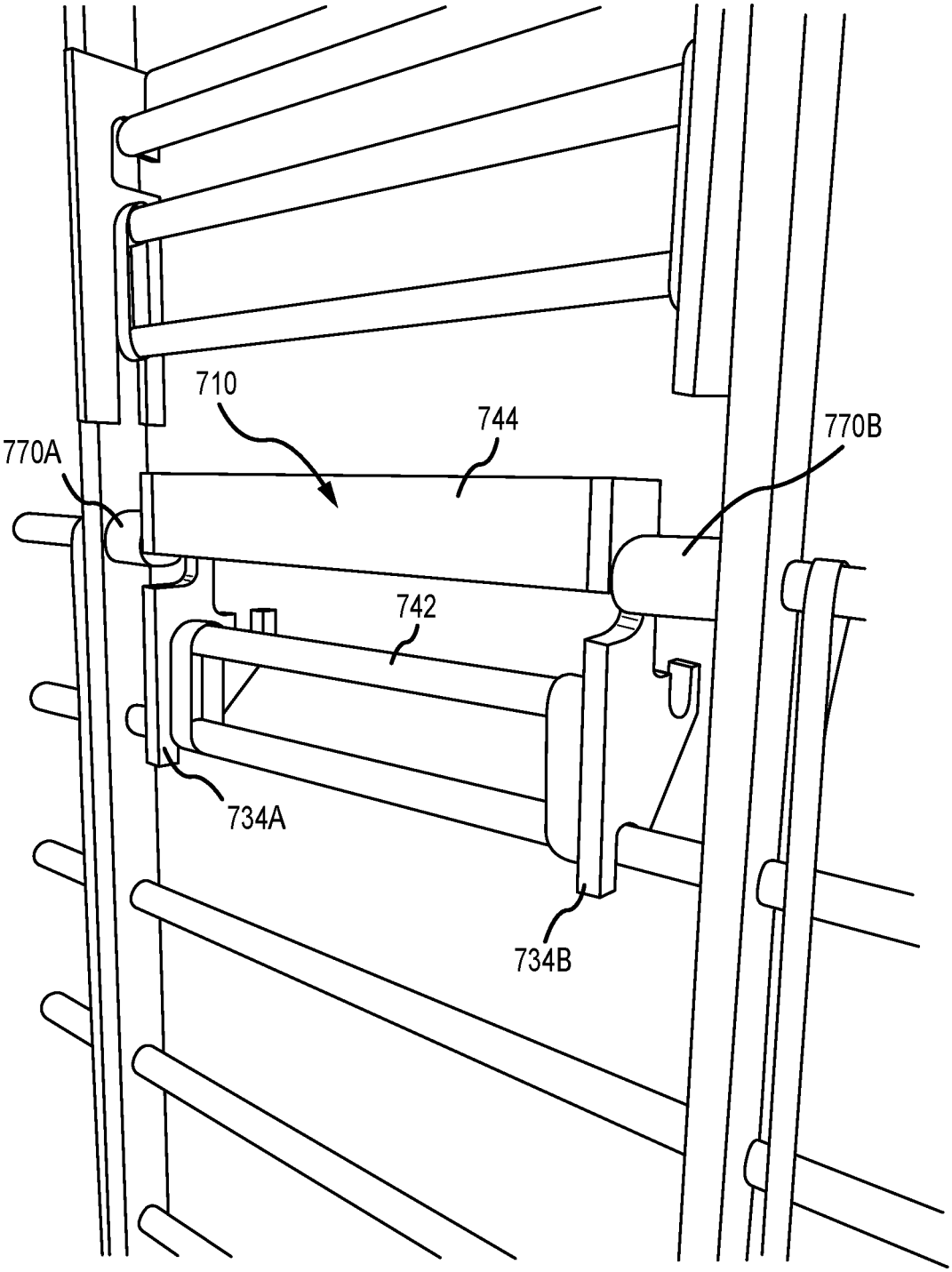
FIG. 11 illustrates a removable crossbar assembly that is secured to an exercise ladder according to an embodiment of the present disclosure.

FIG. 7 and FIGS. 8A and 8B illustrate another embodiment of a removable crossbar attachment and FIGS. 9 to 11 illustrate an exercise ladder arrangement incorporating the removable crossbar assembly. As illustrated in FIG. 7 and FIGS. 8A and 8B, the removable crossbar assembly 710 includes many similar features as the removable crossbar assembly illustrated in FIGS. 1 to 3 above. Thus, the crossbar assembly 710 includes a first bracket 720A and a second bracket 720B that is spaced away from (e.g., horizontally spaced-away from) the first bracket 720A. The brackets 720A/720B are configured to be operatively attached to an exercise ladder (FIGS. 9 to 11) to secure the removable attachment to the exercise ladder. The brackets 720A/720B each include a planar body 722A/722B into which notches, or functionally similar features, are formed to facilitate the securement of the assembly 710 to the exercise ladder.

As with the embodiment of FIGS. 1 to 3, each of the planar bodies includes an inner surface 724A/724B and an outer surface 726A/726B, each surface bounded by a top edge 728A/728B, a bottom edge 730A/730B, a front edge 732A/732B and a back edge 734A/734B. A lower vertical support notch 736A/736B is formed in the bottom edge and is configured (e.g. sized and shaped) to receive a first (lower) exercise ladder crossbar therein. An upper vertical support notch 738A/738B is formed in the planar body, above and substantially vertically colinear with the lower vertical support notch 736A/736B as shown in FIGS. 8A and 8B. The upper vertical support notch 738A/738B is configured (e.g., sized and shaped) to receive a second (upper) exercise ladder crossbar therein, e.g., a second exercise crossbar that is adjacent to and spaced apart (e.g. vertically spaced-apart) from the first exercise bar. A gap 740A/740B is formed in the back edge 734A/734B of the planar body and extends to (e.g., enables access to) the upper vertical support notch 738A/738B to enable the second exercise ladder crossbar to be placed through the gap 740A/740B and into the upper vertical support notch 738A/738B, e.g., without necessitating removal of a crossbar from the exercise ladder.

An exercise assembly crossbar 742 extends across the assembly, e.g., extends from the inner surface 724A of the first bracket 720A to the inner surface 724B of the second bracket 720B. The exercise crossbar 742 is affixed to first and second brackets at a point approximately one-half way between the lower vertical support notch 736A/736B and the upper vertical support notch 738A/738B, although the exercise crossbar 742 may be affixed to the brackets 720A/720B at other positions.

The crossbar assembly 710 also includes a horizontal plank 744 extending along a back side of the attachment, e.g., extending from the first bracket 720A to the second bracket 720B. The horizontal plank 744 is affixed to each of the first and second brackets 720A/720B near the top edge 728A/728B and the back edge 734A/734B of the first and second brackets.

In the embodiment illustrated in FIGS. 7 and 8, each bracket 720A/720B also includes a brace 750A/750B extending from the front edge 732A/732B of the planar body 722A/722B. The braces 750A/750B have a top edge 752A/752B that includes an exercise device receiving notch 754A/754B disposed along the top edge. The exercise device receiving notches 754A/754B are configured (e.g., sized and shaped) to receive and secure an independent exercise device, e.g., having a bar that is sized and shaped to be secured in the notches 754A/754B in spaced-away relation from the front edges 732A/732B of the brackets 720A/720B. The device receiving notches 754A/754B may be substantially vertically coplanar with the attachment exercise crossbar 742, e.g. so that the crossbar and the piece of exercise equipment placed in the equipment notches 754A/754B are disposed at about the same height as shown in FIGS. 8A and 8B. The braces 750A/750B may be integrally formed with the brackets 720A/720B, e.g., fabricated from a single piece of material, such as from wood.

As illustrated in FIG. 9, the assembly 710 may be secured to an exercise ladder by placing the lower vertical support notches 736A/736B onto a first fixed exercise crossbar 764B and the upper vertical support notches 738A/738B onto a second fixed exercise crossbar 764A that is adjacent to and above the first exercise crossbar 764B. The notches 736A/736B and 738A/738B include curved surfaces for receiving the circular (e.g., cylindrical) exercise crossbars therein. Securement straps 766A/766B, e.g., double-sided hook and loop (e.g., Velcro®) straps, may be wrapped around the attachment crossbar 742 and the lower fixed crossbar 764B to further secure the crossbar assembly 710 to the ladder, e.g., to deter upward movement of the attachment. Further, spacer elements (e.g., spacer elements 770A/770B) may be placed onto at least one of the fixed crossbars to deter horizontal movement of the crossbar assembly 710. For example, the spacer elements 770A/770B may be pliable sleeves (e.g. foam sleeves) having a slit along a length of the sleeve to enable the sleeve to be easily placed onto a crossbar.

FIG. 10 illustrates the assembly of FIG. 9 with an exercise device 780 (e.g., a resistance exercise device) secured to the assembly 710. The exercise device 780 illustrated in FIG. 10 is a MOTR® device distributed by Balanced Body, Inc. of Sacramento, CA. See U.S. Pat. No. 8,029,425 by Bronston et al. and U.S. Design Pat. No. D667,899 by Bronston et al., each of which is incorporated herein by reference in its entirety. It will be appreciated that other types of exercise devices may be operatively secured to the assembly 710 as desired, e.g., by being placed within the equipment notches 754A/754B disposed within the braces 750A/750B.

FIG. 11 illustrates a configuration of an exercise arrangement where the crossbar assembly 710 is placed onto the exercise ladder in a reversed configuration as compared to the arrangement illustrated in FIG. 10. That is, the braces 750A/750B are on the back of the exercise arrangement and the plank 744 is exposed on the front of the arrangement. In this configuration, a participant can utilize the flat surface of the plank 744 as leverage, e.g., to push against the plank 744 without the discomfort that may arise when pushing against a cylindrical crossbar while performing an exercise.

Although the foregoing description and the attached figures illustrate a lower vertical support notch disposed in a bottom edge of the brackets, it will be appreciated that the lower notch may be configured in manner similar to the upper vertical support notch. That is, the lower notch may be accessible via a gap in the back edge of the bracket.

While various embodiments of a crossbar assembly and an exercise arrangement have been described in detail, it is apparent that modifications and adaptations of those embodiments will occur to those skilled in the art. However, it is to be expressly understood that such modifications and adaptations are within the spirit and scope of the present disclosure.

What is claimed is:

1. A removable crossbar assembly for use with an exercise ladder, comprising:

first and second horizontally spaced-apart brackets, the first and second brackets each comprising, a planar body having an inner surface and an outer surface, each surface bounded by a top edge, a bottom edge, a front edge and a back edge, a lower vertical support notch formed in the planar body and configured to receive a first exercise ladder crossbar therein, and an upper vertical support notch formed in the planar body, above and vertically colinear with the lower vertical support notch, and configured to receive a second exercise ladder crossbar therein;

an exercise crossbar extending from the first bracket to the second bracket, wherein the exercise crossbar is affixed to each of the first and second brackets between the lower vertical support notch and the upper vertical support notch; and a horizontal plank extending from the first bracket to the second bracket, wherein the horizontal plank is affixed to each of the first and second brackets near the top edge and the back edge of the first and second brackets.

2. The crossbar assembly recited in claim 1, wherein the lower vertical support notch is formed in the bottom edge of the planar body.

3. The crossbar assembly recited in claim 1, wherein the upper vertical support notch is accessed through a gap formed in the back edge of the planar bodies.

4. The crossbar assembly recited in claim 1, wherein the exercise crossbar is affixed between the first bracket and the second bracket at a point approximately one-half way between the upper vertical support notches and the lower vertical support notches.

5. The crossbar assembly recited in claim 1, wherein each of the first and second brackets further comprises:

a brace extending outwardly from the front edge of the planar body, the brace comprising an exercise-equipment receiving notch.

6. The crossbar assembly recited in claim 5, wherein the exercise-equipment receiving notch is disposed in a top edge of the brace.

7. The crossbar assembly recited in claim 6, wherein the exercise-equipment receiving notch is spaced away from the front edge of the first and second brackets.

8. The crossbar assembly recited in claim 5, wherein the exercise-equipment receiving notch is vertically coplanar with the exercise crossbar.

9. An exercise ladder arrangement, comprising:

an exercise ladder comprising first and second spaced-apart vertical supports and at least two exercise ladder crossbars extending between and affixed to the first and second vertical supports;

a crossbar assembly removably secured to the exercise ladder, the crossbar assembly comprising, first and second horizontally spaced-apart brackets, the first and second brackets each comprising, a planar body having an inner surface and an outer surface, each surface bounded by a top edge, a bottom edge, a front edge and a back edge, a lower vertical support notch securing a first exercise ladder crossbar therein, and an upper vertical support notch formed in the planar body, above and vertically colinear with the lower vertical support notch, and securing a second exercise ladder crossbar therein;

an exercise assembly crossbar extending from the first bracket to the second bracket, wherein the exercise assembly crossbar is affixed to each of the first and second brackets; and a horizontal plank extending from the first bracket to the second bracket, wherein the horizontal plank is affixed to each of the first and second brackets near the top edge and the back edge of the first and second brackets.

10. The exercise ladder arrangement recited in claim 9, wherein the exercise assembly crossbar is affixed to each of the first and second brackets at a point approximately one-half the distance between the lower vertical support notch and the upper vertical support notch.

11. The exercise ladder arrangement recited in claim 9, further comprising at least first and second securement straps securing the crossbar assembly to at least the first exercise ladder crossbar to deter vertical movement of the removable exercise assembly relative to the exercise ladder.

12. The exercise ladder arrangement recited in claim 11, wherein the at least first and second securement straps each comprise a hook and loop fastener.

13. The exercise ladder arrangement recited in claim 9, wherein each of the first and second brackets further comprises:

a brace extending from the front edge of the planar body, the brace comprising an exercise-equipment receiving notch disposed therein.

14. The exercise ladder arrangement recited in claim 13, wherein the exercise-equipment receiving notch is formed in a top edge of the brace.

15. The exercise ladder arrangement recited in claim 14, wherein the exercise-equipment receiving notch is spaced away from the front edge of the first and second brackets.

16. The exercise ladder arrangement recited in claim 13, wherein the exercise-equipment receiving notch is vertically coplanar with the exercise assembly crossbar.

17. The exercise ladder arrangement recited in claim 9, further comprising:

at least a first spacer element disposed on at least one of the first and second exercise ladder crossbars between the vertical ladder support and the removable exercise assembly.

18. The crossbar assembly recited in claim 1, wherein the exercise crossbar has a substantially circular cross-section.

19. An exercise ladder arrangement, comprising:

an exercise ladder comprising first and second spaced-apart vertical supports and at least two exercise ladder crossbars extending between and affixed to the first and second vertical supports;

a crossbar assembly removably secured to the exercise ladder, the crossbar assembly comprising, first and second horizontally spaced-apart brackets, the first and second brackets each comprising, a planar body having an inner surface and an outer surface, each surface bounded by a top edge, a bottom edge, a front edge and a back edge, a lower vertical support notch securing a first exercise ladder crossbar therein, and an upper vertical support notch formed in the planar body, above and vertically colinear with the lower vertical support notch, and securing a second exercise ladder crossbar therein, an exercise assembly crossbar extending from the first bracket to the second bracket, wherein the exercise assembly crossbar is affixed to each of the first and second brackets; and at least first and second securement straps securing the crossbar assembly to at least the first exercise ladder crossbar to deter vertical movement of the removable exercise assembly relative to the exercise ladder.

20. The exercise ladder arrangement recited in claim 19, wherein the securement straps comprise a hook and loop fastener.

21. The exercise ladder arrangement recited in claim 19, wherein the exercise assembly crossbar has a circular cross-section.

22. An exercise ladder arrangement, comprising:

an exercise ladder comprising first and second spaced-apart vertical supports and at least two exercise ladder crossbars extending between and affixed to the first and second vertical supports;

a crossbar assembly removably secured to the exercise ladder, the crossbar assembly comprising, first and second horizontally spaced-apart brackets, the first and second brackets each comprising, a planar body having an inner surface and an outer surface, each surface bounded by a top edge, a bottom edge, a front edge and a back edge, a lower vertical support notch securing a first exercise ladder crossbar therein, and an upper vertical support notch formed in the planar body, above and vertically colinear with the lower vertical support notch, and securing a second exercise ladder crossbar therein, an exercise assembly crossbar extending from the first bracket to the second bracket, wherein the exercise assembly crossbar is affixed to each of the first and second brackets; and at least a first spacer element disposed on at least one of the first and second exercise ladder crossbars between the vertical ladder support and the removable exercise assembly.

23. The exercise ladder arrangement recited in claim 22, wherein the exercise assembly crossbar has a circular cross-section.

24. The exercise ladder arrangement recited in claim 22, wherein the at least first spacer element comprises a pliable sleeve having a slit along a length of the sleeve to enable the sleeve to be placed on at least one of the first and second exercise ladder crossbars.

* * * * *